US006915930B2

(12) United States Patent
Dixon

(10) Patent No.: US 6,915,930 B2
(45) Date of Patent: Jul. 12, 2005

(54) CAP HANGER

(76) Inventor: Jerry J. Dixon, 3780 W. Dakota Ave., Apt. 102, Fresno, CA (US) 93722

( * ) Notice: Subject to any disclaimer, the term of this patent is extended or adjusted under 35 U.S.C. 154(b) by 82 days.

(21) Appl. No.: 10/411,678

(22) Filed: Apr. 11, 2003

(65) Prior Publication Data

US 2004/0079773 A1 Apr. 29, 2004

Related U.S. Application Data

(60) Provisional application No. 60/421,858, filed on Oct. 29, 2002.

(51) Int. Cl.[7] ..... A41D 27/22

(52) U.S. Cl. ..... 223/85

(58) Field of Search ..... 223/85, 87; 206/8, 206/9; 211/30, 85.3

(56) References Cited

U.S. PATENT DOCUMENTS 3,378,180 A * 4/1968 Singer ..... 223/87

5,967,388 A * 10/1999 Kolton et al. ..... 223/95

* cited by examiner

*Primary Examiner*—John J. Calvert
*Assistant Examiner*—James G Smith
(74) *Attorney, Agent, or Firm*—Richard A. Ryan

(57) ABSTRACT

A hanger for hanging one or more hats, particularly baseball-style caps, from a support member. The cap hanger has an upper portion with a hook, a middle portion suitable for displaying information and a lower portion having a hanger body with one or more hanger sections. The hanger sections are configured to receive and retain the back portion, either the back side of the cap or the strap or band, whether adjustable or not, of a cap in a cap receptacle and suspend the cap in a generally downward direction. The hanger sections can have an upper channel and a plurality of lower channels separated by a protruding member and a shaped narrowed section to hold the cap in the cap hanger. The cap hanger can also have one or more brim clips, separately or in combination with hanger sections, for receiving and retaining the brim of a cap.

39 Claims, 8 Drawing Sheets

CAP HANGER

CROSS-REFERENCE TO RELATED APPLICATIONS

This application claims the benefit of U.S. Provisional Application No. 60/421,858 filed Oct. 29, 2002.

BACKGROUND OF THE INVENTION

A. Field of the Invention

The field of the present invention relates generally to hangers for hanging various types of hats, including visors and baseball-style caps having solid or strap backs and which are one size or adjustable. More particularly, the present invention relates to such hat hangers which are configured for hanging caps without damaging or modifying the brim of the cap. Even more particularly, the present invention relates to hat hangers which have one or more hanger sections configured to easily receive and securely hold a portion of the hat therein.

B. Background

A person's choice of dress generally includes various accessory articles that are used to enhance their appearance and/or which can provide functional benefits for the person. Accessory articles include hats, visors, headbands, belts and purses. Hats are utilized to protect the wearer's head, hair and face from the weather, including sun, rain and snow, to keep their hair relatively in place on windy days, to protect eyeglasses from the rain and fog, and to shade the eyes on sunny days. Visors provide some of the same benefits as hats, including keeping the wearer's hair in place, protecting eyeglasses and shading the eyes. Headbands also keep the wearer's hair in place and reduce the likelihood of sweat dripping into the wearer's eyes.

Many people enjoy wearing hats for various different purposes and occasions. One of the most popular style of hats is the "baseball-style" cap having a cap portion that covers the head from which a stiff brim extends forward to shade the eyes and protect the forehead from exposure to the sun. The cap portion is either configured to be a one size fits all or to have an adjusting mechanism to vary the size of the cap portion to better fit a person's head. The one size fits all type of cap can have a cap portion with solid back portion or a non-adjustable strap across the back of the cap portion. Adjustable caps typically either have a strap with a slidable buckle or a prong and hole apparatus at the back side of the cap portion that lengthens or shortens the strap. As is well known, many people like to shape the brim of the cap by bending it in an arch shape such that it bends downwardly toward the face when worn on the person's head.

One problem common to most accessory items and hats in particular is what to do with the item when it is not in use. Oftentimes, people hang the accessory item on racks having one or more hanging members extending from the rack. Some of these are speciality racks, in that they are particularly configured to hang a hat, belt or other item thereon. Generally, these speciality types of racks are mounted on a wall so that the hanging members extend outwardly from the wall. For convenience the hanging rack may be located in a closet, coat room or near entrance/exit doors. Freestanding coatracks are also employed to hang accessory items thereon. When a rack is not available or is already full of accessory items, many people utilize various flat surfaces, such as shelves, tables, cabinet tops and the like as a location to place or stack accessory items.

As is well known, unless care is used to neatly place the accessory items, they can become a mess that is both unsightly and potentially damaging to the accessory items. With regard to hats and visors in particular, the placement of hats and visors when not in use can be especially bothersome. It is not uncommon for persons to have a number of different hats of varying types that they wear for different uses or occasions. For example, many people have multiple baseball-style caps that have different statements and/or designs on the front and/or back portions of the cap, such as sports team logos, product names and logos, recreational areas and the like. Although hat racks and related devices may be able to hold multiple caps, visors, head bands and other articles, such racks require their own location to allow room for the rack and articles placed thereon. A better article holder would be one that is configured to cooperate with a closet rod hanger bar, such as those used to suspend clothes hangers having an article of clothing on each hanger in a closet or other compartment with other hangers having clothes thereon.

Several prior art hat holders are configured to hold one or more hats, including baseball-style caps, on a clothes hanger rod in a closet or other compartment. One such prior art cap holder is U.S. Pat. No. 6,196,428 to Robak, which discloses a combination cap hanger and cap brim curving device that has a hook portion configured for the typical clothes hanging rod and one or more sleeves configured to receive and shape the cap brim. The brim of the cap is rolled inward and placed in the sleeve such that the front of the cap is displayed above the hanger. The hanger body is curved inwardly to form an arch at approximately 120 degrees. Another prior art device, disclosed in U.S. Pat. No. 4,927,063 to Fricano, is a combination cap hanger and visor press having a pair of spring loaded gripping members configured to grip the brim of the cap. Apertures on the handles of the gripping members allow the device to be hung on a hook. Another hat hanger, configured in a generally semi-circular shape out of spring wire, is disclosed in U.S. Pat. No. 2,177,546 to Johnson. The hat hanger has two spaced apart arcuate supporting members that enclose the crown portion of the hat (typically a "top hat" type of hat) and a hook to suspend the hat hanger from a rod or hook. U.S. Pat. No. 2,108,678 to Kulhawy discloses a hat hanger made out of a compressible member (i.e., wire) configured into a loop portion that goes inside the hat to support the hat and a hook portion that connects to the loop portion to suspend the hat hanger. Design Pat. No. D436,742 to Mueller discloses a cap hanger that hangs a single cap on a hook or rod by engaging the cap by its brim in a generally arch shape. Design Pat. No. D346,700 to Weinhold discloses a sport cap hanger suitable for hanging on a rod or hook to hold a single cap. Design Pat. Nos. D319,738 and D309,219 to Hasslocher illustrate cap hangers configured to receive multiple hats in a stacking fashion. The cap hangers have a hook portion suitable for hanging the cap hangers on a rod or hook.

Although the prior art discloses devices for hanging hats, caps and other like articles, none of the presently known hangers are particularly configured to easily yet securely hold multiple baseball-style caps or the like on a hanger rod, such as those used in a closet, in a manner that does not shape or interfere with the shape of the brim of the cap. The devices which shape the brim do so by bending it in what is perceived as a preferred arch. In fact, however, not everyone prefers the particular arch shape disclosed in the prior art devices. The devices which hold a single hat by gripping the crown or being inserted into the hat do not work well for baseball-style caps and require too much closet space for the typical cap owner who has multiple caps. Therefore, what is needed is an improved cap hanger that securely holds multiple caps without damaging or modifying the cap brim and which is also suitable for holding other related articles, such as visors, headbands, belts, clothing and other articles having straps and the like. The preferred cap hanger should be configured to receive and securely hold caps with different types of backs on the cap portion and different types and sizes of adjustable mechanisms.

SUMMARY OF THE INVENTION

The cap hanger of the present invention solves the problems identified above. That is to say, the present invention discloses a cap hanger that is configured to securely hold multiple baseball-style caps on a closet rod or like device. The cap hanger receives the cap in a manner that does not interfere with the owner's preferred arch shape of the brim portion of the cap. The cap hanger can receive and securely hold caps having different types and sizes of back portions, whether configured with an adjustable mechanism or not. The cap hanger can also be used to hang related articles, such as visors, headbands, belts, purses and various other articles, on a closet rod, hook or other like apparatuses.

In the preferred embodiment, the cap hanger of the present invention is comprised principally of an upper portion, lower portion and one or more hanger sections in the lower portion. The upper portion has a hook configured to removably attach and retain the cap hanger on a support member such as a closet rod, hook or like device. The lower portion has a hanger body with a first end and an opposing second end, a top side and an opposing bottom side, and one or more hanger sections. In one configuration, the upper portion is connected to the top side of the lower portion. In the preferred configuration, a middle portion is disposed between the upper and lower portions. The middle portion can have a design or be configured to display advertising, sports, inspirational or other messages. Each of the hanger sections has an opening at the bottom side of the hanger body connected to a passageway, which interconnects the opening with an open cap receptacle inside the hanger body. The hanger section has a protruding member disposed along the passageway for guiding, supporting and holding a cap in the cap hanger. The cap receptacle also includes one or more lower channels below the protruding member for receiving the back portion of the cap (i.e., the strap, adjustable strap or band or the back of the cap portion). The channels can be formed by pairs of steps in the cap receptacle. In the preferred embodiment, the cap receptacle includes a plurality of lower channels, each having a different width. Also in the preferred embodiment, there is an extension area in the cap receptacle that, with the passageway, forms an upper channel for receiving and retaining the back portion of the cap. The cap hanger can also have a narrowed section disposed between the upper channel and the plurality of lower channels, with one side of the narrowed section, the side opposite the channel, formed at an angle to facilitate entry of the cap into the lower channels. A detent can be positioned in the upper channel, the detent sized and configured to secure a back portion of the cap in the cap receptacle. Extension members can attach to the lower portion to connect to one or more additional cap hangers for suspending more caps from the same support member. One or more brim clips, configured to releasably grip the brim of a cap, can attach to the lower portion to hang caps therefrom.

Accordingly, the primary objective of the present invention is to provide a cap hanger for hanging caps and related articles that overcomes the disadvantages associated with presently available cap hangers.

It is also an important objective of the present invention to provide a cap hanger that securely holds multiple hats and caps, particularly baseball-style caps, on a closet rod or like apparatus It is also an important objective of the present invention to provide a cap hanger that does not shape or modify the user's chosen shape of the brim portion of the hat or cap.

It is also an important objective of the present invention to provide a cap hanger that receives the back portion of a baseball-style cap and securely holds the cap in place whether the cap is configured with an adjusting mechanism or not.

It is also an important objective of the present invention to provide a cap hanger that is configured with multiple hanger sections each configured to securely hold a cap or other article on a closet rod or like apparatus.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
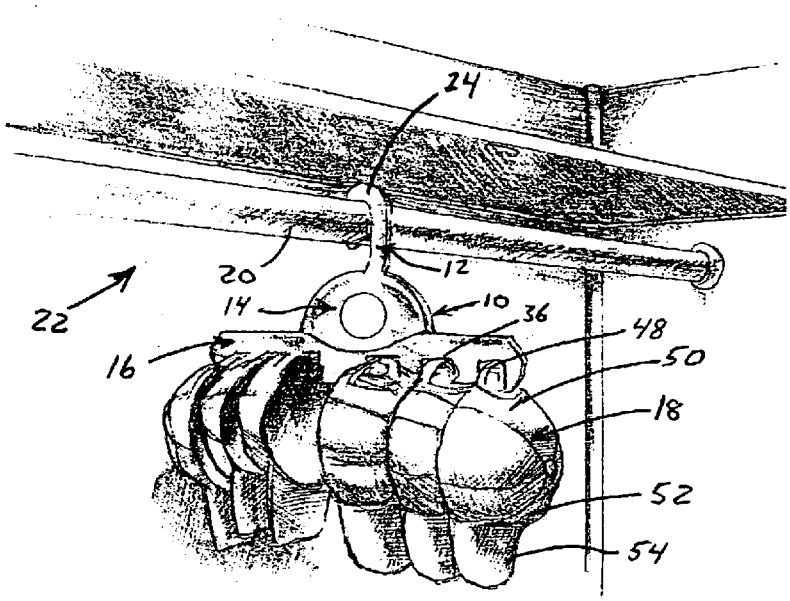
FIG. 1 is a perspective view of a cap hanger of the present invention hanging on a closet rod in a closet and holding a plurality of caps thereon.
Figure 2:
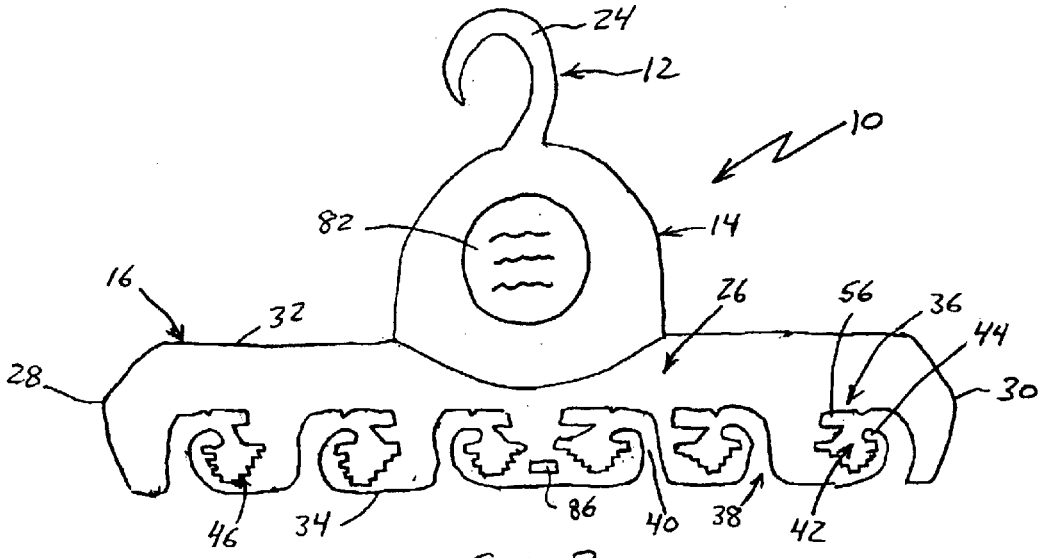
FIG. 2 is a side view of a preferred cap hanger of the present invention utilizing a plurality of hanger sections configured to receive and retain a cap therein.

With reference to the figures where like elements have been given like numerical designations to facilitate the reader's understanding of the present invention, and particularly with reference to the embodiment of the present invention illustrated in FIGS. 1 through 3, the preferred embodiments of the present invention are set forth below. The cap hanger of the present invention, identified generally as 10, generally comprises an upper portion 12, a middle portion 14 and a lower portion 16 configured to receive and securely hold one or more caps 18 on a support member 20, as shown in FIG. 1. Support member 20 can be a closet rod commonly used in closets, shown as 22 in FIG. 1, or support member 20 can be a hook, pin or other supporting device whether used in a closet or elsewhere (i.e., attached to a wall). Cap hanger 10 of the present invention is configured to removably attach to and be retained by support member 20. To facilitate this, the preferred embodiment of cap hanger 10 utilizes upper portion 12 having an upstanding hook 24 that extends upwardly from middle portion 14, as shown in FIGS. 1 and 2. Alternatively, hook 24 can be of the type that does not stand upwardly on its own when cap hanger 10 is not in use. Cap hanger 10 can be made out of a variety of materials, including plastic, metal, wood, composites and various other materials depending on cost and availability. Plastics such as polypropylene and polyethylene can be used. Injection molded plastic, for instance, is known to have certain production and cost benefits.

Lower portion 16 is configured to hold caps 18. In the preferred embodiment, best shown in FIG. 2, lower portion 16 has a hanger body 26 with a first end 28, an opposing second end 30, a top side 32 and an opposing bottom side 34, such that middle portion 14 connects to top side 32 and bottom side 34 is generally disposed in the direction of the ground in closet 22. To hold caps 18, hanger body 26 has one or more hanger sections 36 disposed therein. Each of said hanger sections 36 has opening 38 that opens to bottom side 34. As set forth in more detail below, opening 38 is configured to receive the back portion of a cap 18, such as the back side of the cap portion or the adjustable mechanism on the back side of cap 18. As best shown in FIGS. 2 through 9, opening 38 connects to passageway 40 that interconnects opening 38 with cap receptacle 42 in hanger section 36. To assist in holding the portion of cap 18 in cap hanger 10, hanger section 36 includes a protruding member 44 that forms part of passageway 40 and which extends into passageway 40 and/or cap receptacle 42. Inside cap receptacle 42 and at least below the top of protruding member 44 is provided at least one lower channel 46. In the embodiment shown in FIG. 8, for instance, only one such lower channel 46 is utilized. Lower channel 46 should be sized and configured to receive the typical band or strap 48, whether adjustable or not, used on the back portion 50 of many designs of cap 18. For those caps 18 not having a back band or strap 48, channel 46 can cooperate with cap receptacle 42 to receive a folded portion of the back side 50 of cap 18 (as explained in more detail below). The front portion 52 of cap 18, having brim 54 extending therefrom, hangs unmolested below cap hanger 10, as best illustrated in FIG. 1.

Figure 3:
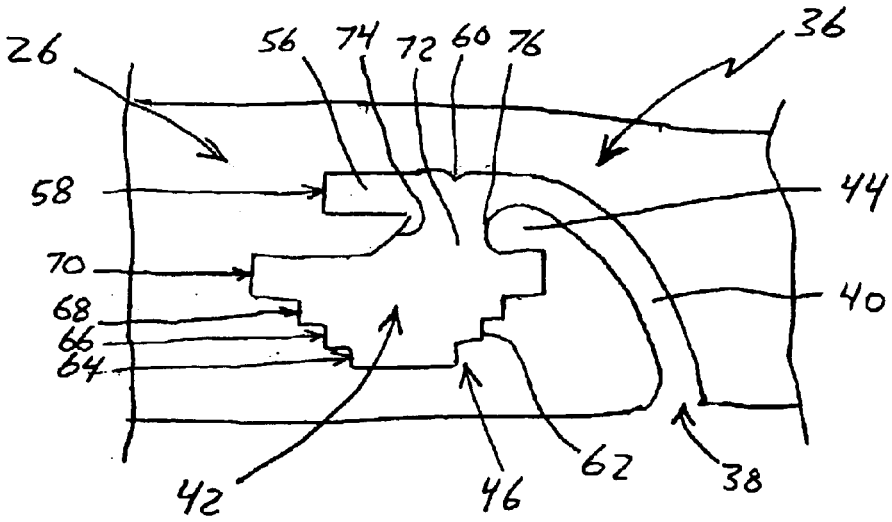
FIG. 3 is an isolated view of the hanger section utilized with the cap hanger of FIG. 2.
Figure 4:
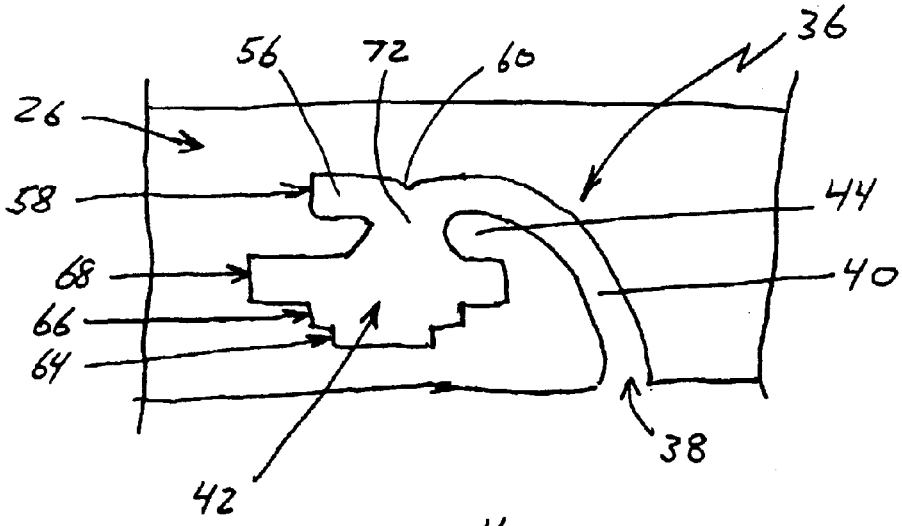
FIG. 4 is an isolated view of an alternative hanger section for use with the cap hanger of the present invention.
Figure 5:
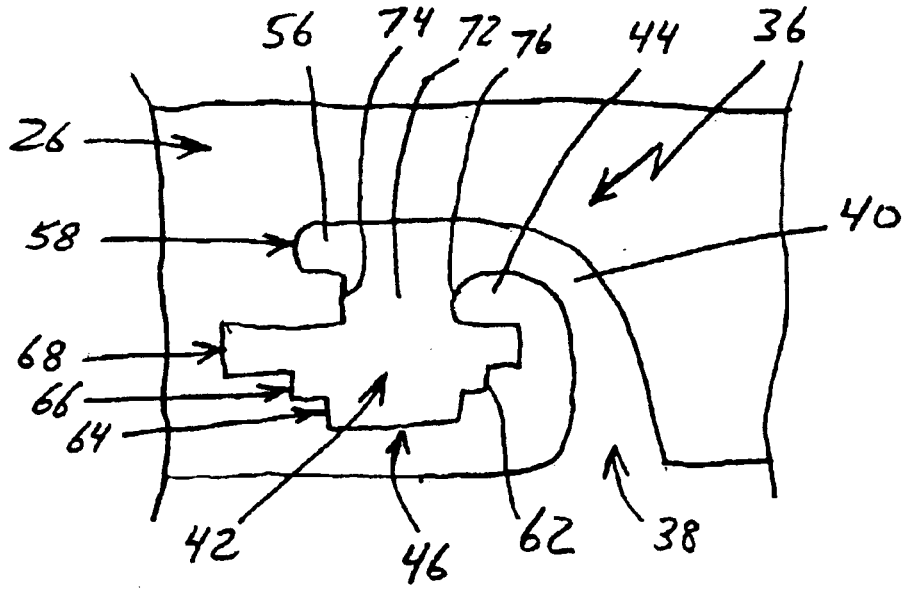
FIG. 5 is an isolated view of another alternative hanger section for use with the cap hanger of the present invention.
Figure 6:
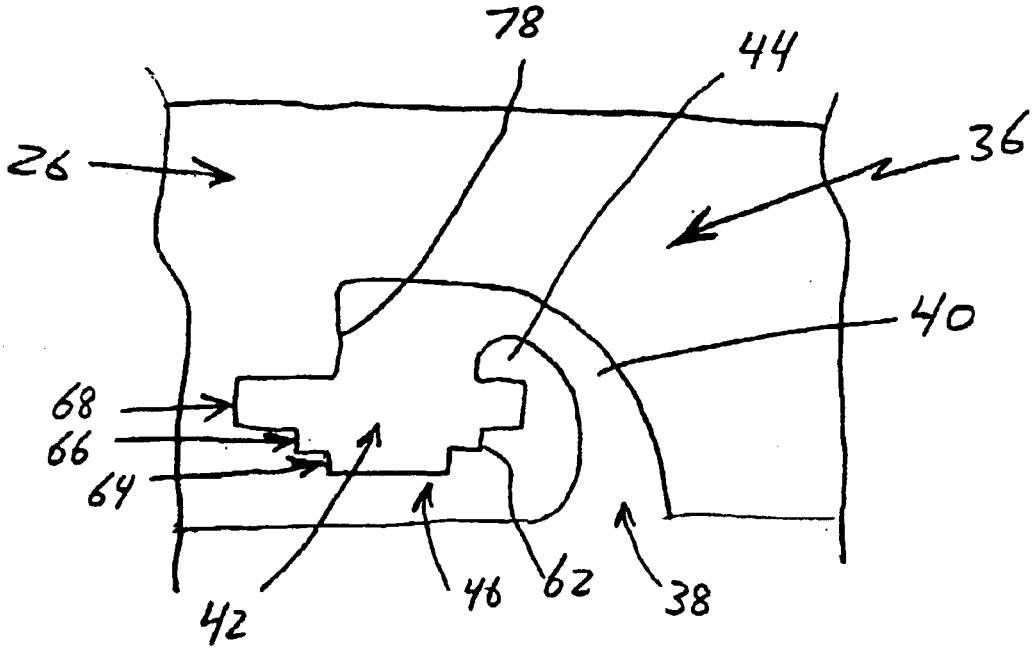
FIG. 6 is an isolated view of yet another alternative hanger section for use with the cap hanger of the present invention.
Figure 7:
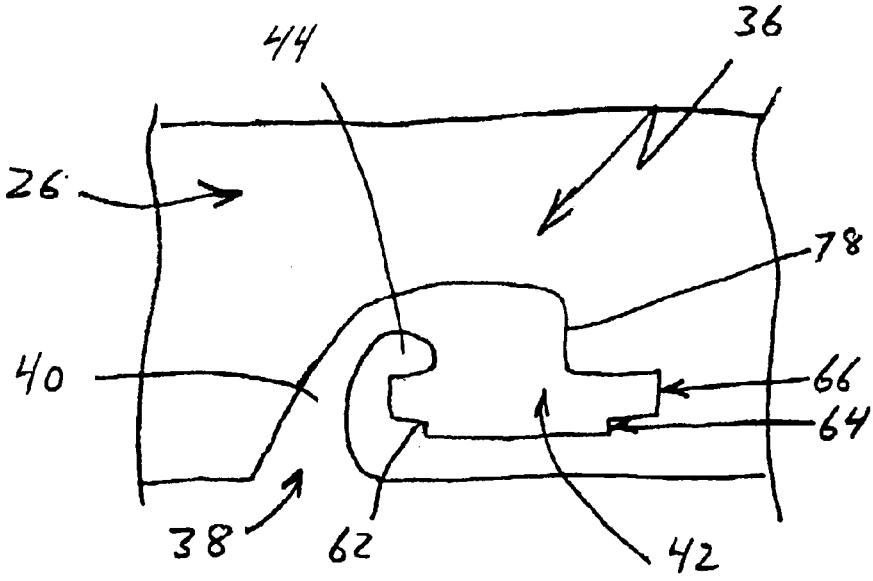
FIG. 7 is an isolated view of yet another alternative hanger section for use with the cap hanger of the present invention.
Figure 8:
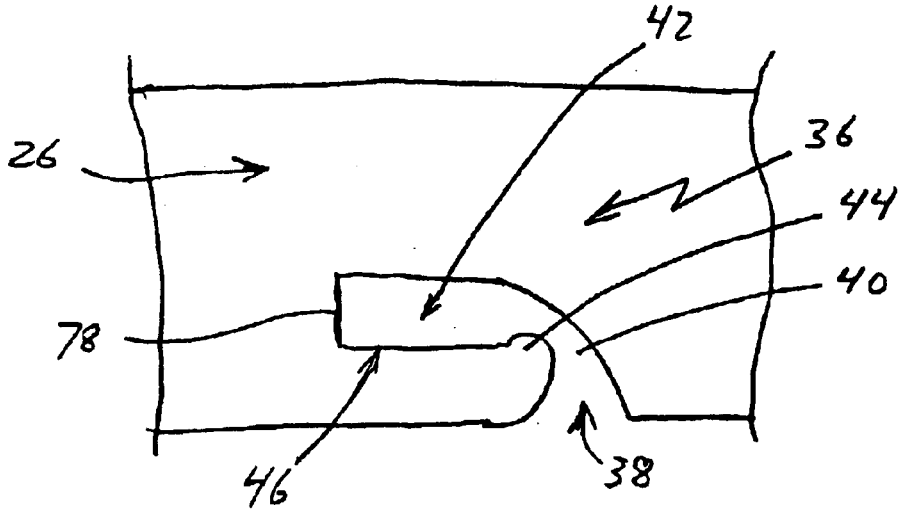
FIG. 8 is an isolated view of yet another alternative hanger section for use with the cap hanger of the present invention.
Figure 9:
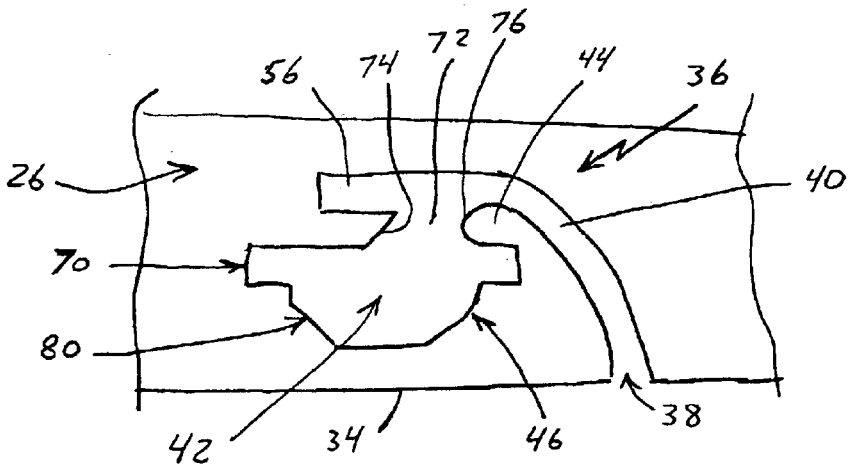
FIG. 9 is an isolated view of yet another alternative hanger section for use with the cap hanger of the present invention.

In addition to the basic components described above, which are shown in the configuration for hanger section 36 shown in FIG. 8, the cap hanger 10 of the present invention is adaptable to a variety of different configurations for hanger section 36, as shown in FIGS. 3 through 7 and FIG. 9. A preferred configuration for hanger section 36 is shown in FIG. 3. As described below, this configuration includes various modifications to the basic configuration described above that provides certain benefits with regard to different cap configurations or types. The embodiment shown in FIG. 3 includes an extension area 56 that forms upper channel 58. Upper channel 58 is particularly configured to receive the back portion 50 of cap 18 therein either by placing the edge of cap 18 or a folded back portion 50 of cap 18 through opening 38, passageway 40 and into upper channel 58. To better hold cap 18 in cap hanger 10, hanger section 36 includes detent 60 between passageway 40 and extension area 56 that protrudes into upper channel 58 to narrow it slightly and cause a holding action against cap 18. As shown in FIG. 3, lower channel 46 can be comprised of multiple channels, such as the four shown, formed by steps 62. In this embodiment, first lower channel 64, second lower channel 66, third lower channel 68 and fourth lower channel 70 are formed by pairs of steps 62 such that each of the channels 64, 66, 68 and 70 have different channel widths (being the distance across the steps). The varying widths of lower channels 46 are configured to receive cap bands or straps 48 of different widths so that the band or strap 48 will lay across the channel (64, 66, 68 or 70) of the appropriate width. It has been found that, in general, some of the leather or leather-like caps have narrower bands or straps 48 and the adjustable plastic snap-type bands 48 are wider. If desired, the height of channels 64, 66, 68 and 70 can also be varied. Hanger section 36 can comprise narrowed section 72, having first side 74 and second side 76, disposed between upper channel 58 and lower channel 46 or lower channels 64, 66, 68 and 70, as best shown in FIGS. 3 through 5 and 9. As shown in FIGS. 3, 4 and 9, first side 74 can be angled to facilitate entry of strap 48 or the back portion 50 of cap 18 into the area of lower channels 64, 66, 68 and 70 and to assist in holding strap 48 or back portion 50 in cap receptacle 42, particularly when back portion 50 of cap 18 is curled or folded into cap receptacle 42.

Alternative embodiments of hanger sections 36 for use in the cap hanger 10 of the present invention are shown in FIGS. 4 through 9. FIG. 4 shows a hanger section 36 having only a first channel 64, second channel 66 and third channel 68, angled first side 74 of narrowed section 72 and extension area 56 with upper channel 58 and detent 60. This embodiment, while similar to the embodiment of FIG. 3, has one less lower channel 46, thereby making it less versatile, but less expensive to manufacture. The embodiment shown in FIG. 5 also has only three lower channels 46 (only channels 64, 66 and 68) and no angled first side 74 of narrowed section 72 and no detent 60. The embodiment shown in FIG. 6 is similar to that shown in FIG. 5 except that no extension area 56 is used at the end of passageway 40 and, as a result, there is no narrowed section 72. Instead, the edge of hat 18 will enter opening 38, pass through passageway 40 and rest against far edge 78. The embodiment shown in FIG. 7 is similar to that shown in FIG. 6 except that it utilizes a two lower channel 46 configuration, channels 64 and 66. As discussed above, the embodiment shown in FIG. 8 utilizes a single lower channel 46. The embodiment shown in FIG. 9 utilizes upper channel 58, detent 60, narrowed section 72 with angled first side 74 and multiple lower channels 46. In this configuration, the area below fourth lower channel 70 (in FIG. 3) is a single large channel having angled channel sides 80 without steps 62 shown in other embodiments. Angled channel sides 80 allow a greater number of varying widths of straps 48 to be placed inside and supported by cap receptacle 42 so as to suspend caps 18 from cap hanger 10.

Figure 10:
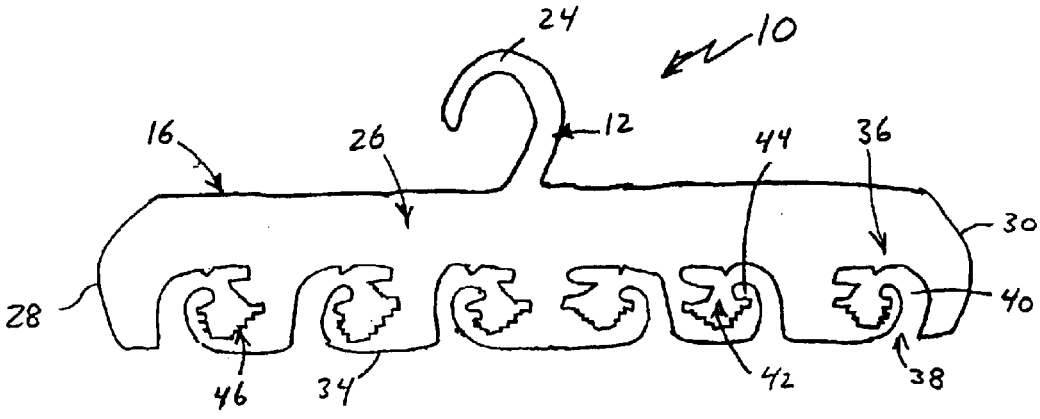
FIG. 10 is a side view of an alternative cap hanger of the present invention utilizing a plurality of hanger sections configured to receive and retain a cap therein.

Although the preferred embodiments of cap hanger 10 includes middle portion 14, cap hanger 10 can be configured with just upper portion 12 and lower portion 16. In this configuration, shown as FIG. 10, upper portion 12 directly connects to top side 32 of lower portion 16. As shown in FIGS. 1 and 2, one benefit of middle portion 14 is that it can be configured with a design or to include display item 82 thereon (FIG. 2). Display items 82 can include advertising, sports slogans, identifying insignia or other information (including those that are religious, inspirational or motivational in nature).

Figure 11:
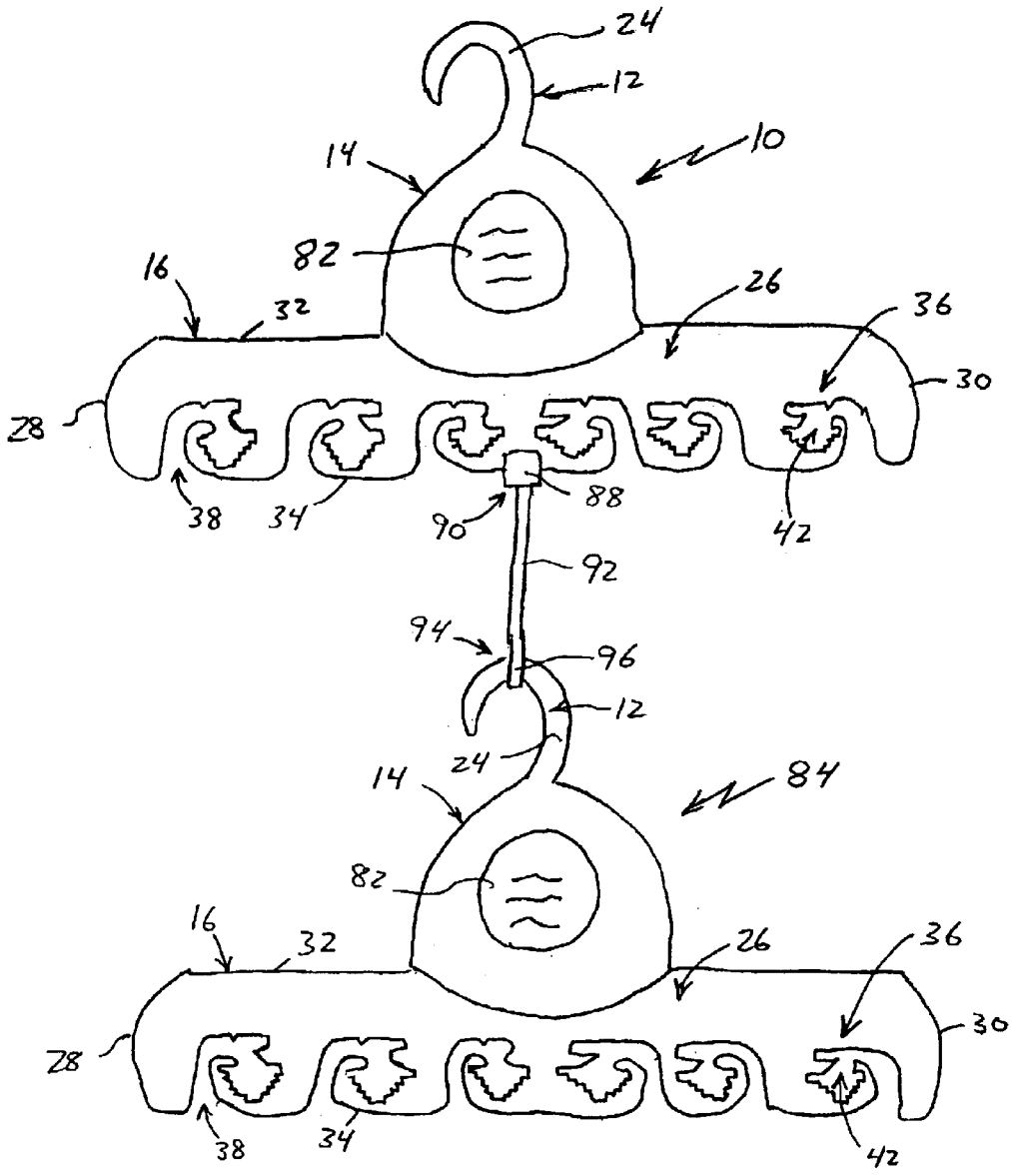
FIG. 11 is a side view of a cap hanger of the present invention showing use of an extension member to connect to a second cap hanger.

Cap hanger 10 of the present invention can also be configured to connect to one or more additional cap hangers 84. One such configuration is the use of slot 86, shown in FIG. 2. Slot 86 can be configured to receive connector 88 located at the upper end 90 of extension member 92. Connector 88 can be of the snap-type that snaps onto the bottom side 34 of lower portion 16 around slot 86, as shown in FIG. 11. The lower end 94 of extension member 92 can be configured with an extension hook 96 to removably receive hook 24 of lower cap hanger 84. Extension member 92 should be of sufficient length to place the lower cap hanger 84 far enough below cap hanger 10 such that caps 18 hanging from cap hanger 10 do not substantially contact cap hanger 84 to prevent damage to caps 18. With extension member 92, multiple levels of cap hangers 10 and 84 can be used to store caps 18.

In use, cap hanger 10 of the present invention can be configured with multiple hanger sections 36, such as the six shown in FIG. 2, for receiving and retaining multiple caps 18. For caps 18 configured with a solid back portion 50 (i.e., having no back strap or band 48), the user will generally utilize upper channel 58 by moving the edge of the back portion 50 of cap 18 into passageway 40 through opening 38 to cap receptacle 42. Alternatively, back portion 50 of cap 18 can be directed downward into lower channels 46 and, if necessary or desirable, curled or folded inside cap receptacle 42. Protruding member 44 and angled first side 74 of narrowed section 72 will help hold cap 18 in place. In either use, cap 18 will be suspended from cap hanger 10 by its back portion 50 resting against the solid portions of hanger section 36 at upper channel 58 in a manner that results in brim 54 of cap 18 being pointed generally downward, as shown in FIG. 1. Cap 18 can be removed from cap hanger 10 by sliding back portion 50 directly out upper channel 58 or uncurling or unfolding back portion 50 prior to removal. For caps 18 configured with a strap or band 48, whether adjustable or not, the user will utilize cap hanger 10 by pivoting the strap or band 48 upward and sliding strap or band 58 through opening 38 into passageway 40 and to lower channels 46 (i.e., channels 64, 66, 68 and 70) of cap receptacle 42. Depending on the width of strap or band 58 and lower channels 46, the strap or band 58 of cap 18 will rest in lower channel 64, 66, 68 or 70 to suspend cap 18 from cap hanger 10 such that brim 54 of cap 18 is pointing generally downward. Protruding member 44 and angled first side 74 of narrowed section 72 will help hold cap 18 in place. Cap 18 is removed from cap hanger 18 by moving the strap or band 48 in the opposite direction described above. If extension member 92 is utilized, lower cap hanger 84 can be used to suspend even more caps 18 from support member 20. In this manner, other cap hangers can be attached to and hang below lower cap hanger 84. In addition to caps 18, cap hanger 10 of the present invention can be utilized to hang visors, headbands, purses, belts, dresses and other items having bands or straps.

Figure 12:
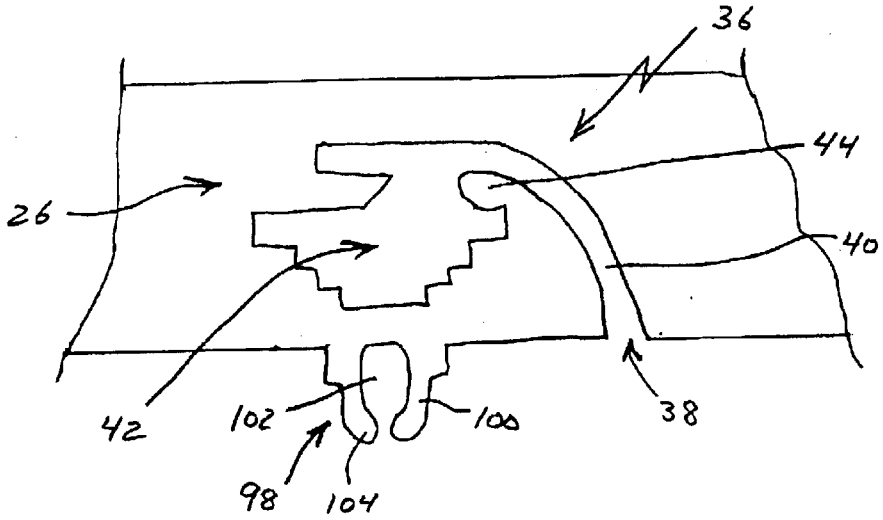
FIG. 12 is an isolated view of a hanger section for use with the cap hanger of the present invention with a brim clip on the bottom side of the hanger below the hanger section.

In an alternative configuration of the cap hanger 10 of the present invention, shown in FIG. 12, cap hanger 10 includes one or more brim clips 98 at lower portion 16 for receiving the brim 54 of cap 18. As shown in FIG. 12, brim clip 98 can be made integral with lower portion 16 (i.e., molded with hanger 10) such that it extends generally downward from bottom side 34. Alternatively, brim clip 98 can be separate members that attach or which are affixed to lower portion 16. In one configuration, brim clip 98 comprises a pair of downwardly extending clip arms 100 that are shaped and configured to securely yet releasably receive brim 54 into clip cavity 102 between clip arms 100. Clip arms 100 can be configured to flex or spread apart as the leading edge of brim 54 is inserted therebetween so as to tightly grasp brim 54. Many caps 18 have brims 54 with threaded sections thereon which can be grasped be brim clip 98. The ends 104 of clip arms 100 can be shaped to facilitate grasping brim 54 in brim clip 98. When combined with cap hanger 10 having hanger section 36, the user can select whether he or she wants to hang cap 18 from its back portion 50 in hanger section 36 or from its brim 54 in brim clip 98.

Figure 13:
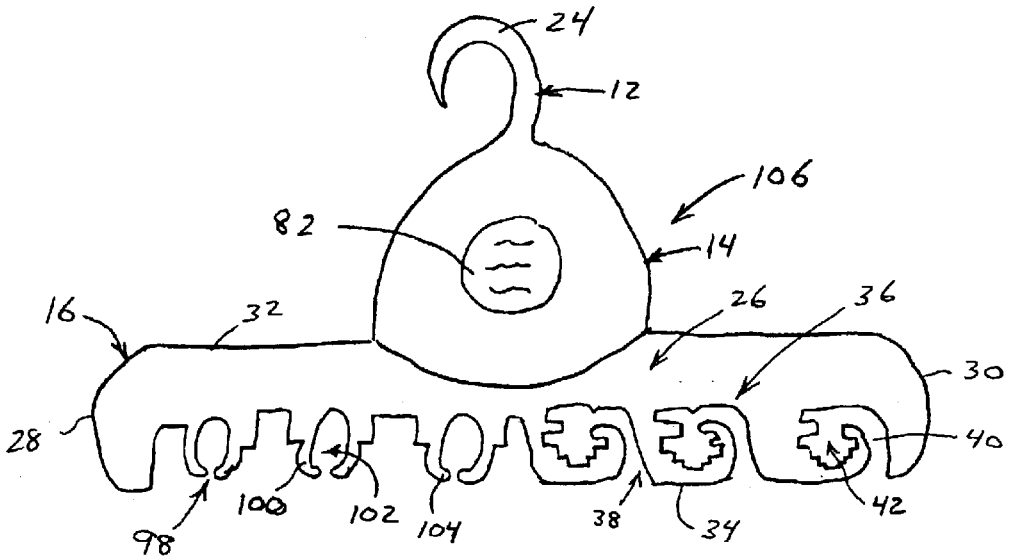
FIG. 13 is a side view of a cap hanger utilizing multiple brim clips each configured to hold the brim of a cap and multiple hanger sections for holding the back portion of a cap.
Figure 14:
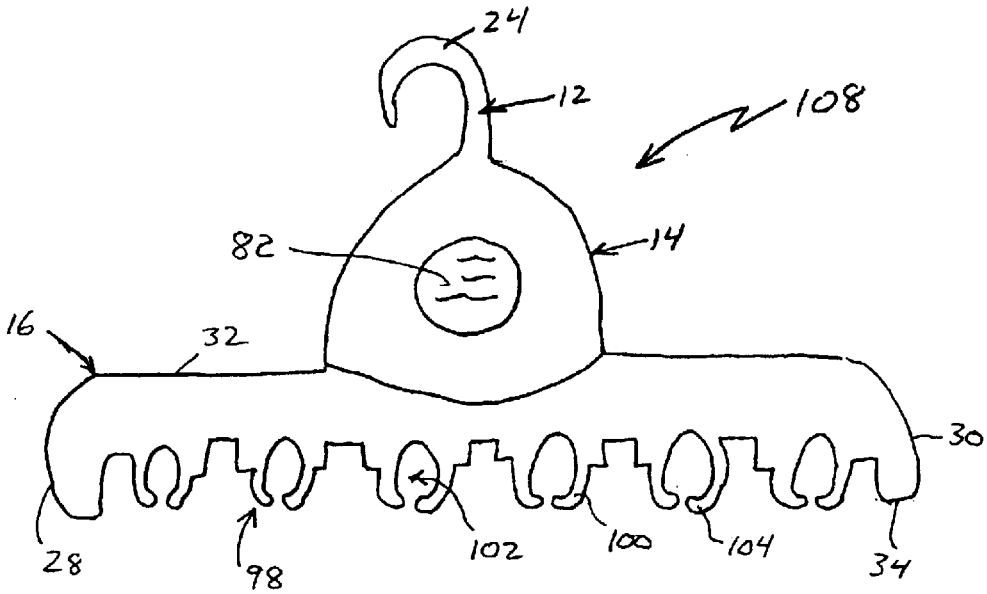
FIG. 14 is a side view of a cap hanger utilizing multiple brim clips each configured to hold the brim portion of cap.

As shown in FIG. 13, cap hanger 106 can be configured with lower portion 16 having one or more hanger clips 98 in addition to separate hanger sections 36. In this configuration, as with the previously described embodiment, upper portion 12 is configured to removably attach to and be retained by support member 20. If desired, an upstanding hook 24 can be utilized to connect to support member 20. As with the previous embodiment, cap hanger 106 can be configured with or without middle portion 14, configured as described above. As shown, cap hanger 106 can be configured with a combination of separate hanger clips 98 and hanger sections 36, for example three of each on opposite sides of hanger 106, to allow the user to choose whether he or she wants to hang a particular cap 18 from its back portion 50 or its brim 54. Alternatively, as shown in FIG. 14, cap hanger 108 can be configured with lower portion 16 having one or more hanger clips 98 only (i.e., no hanger sections 36) across the entire lower portion 16.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A cap hanger, comprising:

an upper portion configured to removably attach and retain said cap hanger on a support member;

a lower portion having a hanger body with a first end, an opposing second end, a top side and an opposing bottom side, said upper portion connected to said top side of said lower portion;

one or more hanger sections in said hanger body, each of said hanger sections having an opening at said bottom side of said hanger body connected to a passageway, said passageway interconnecting said opening with a cap receptacle, said hanger section having a protruding member disposed along said passageway; and one or more lower channels in said cap receptacle below said protruding member for receiving a back portion of a cap therein at least one of said one or more lower channels formed by a pair of steps in said cap receptacle.

2. The cap hanger according to claim 1 further comprising a plurality of lower channels in said cap receptacle, each of said lower channels having a different channel width.

3. The cap hanger according to claim 2 further comprising an extension area in said cap receptacle, said extension area and said passageway forming an upper channel.

4. The cap hanger according to claim 3, wherein said cap receptacle has a narrowed section disposed between said upper channel and said plurality of lower channels, said narrowed section formed between a first side and an opposing second side, said second side comprised of said protruding member.

5. The cap hanger according to claim 4, wherein said first side is formed at an angle to facilitate entry of said cap into said lower channels.

6. The cap hanger according to claim 4 further comprising a detent in said upper channel, said detent sized and configured to secure a back portion of said cap in said cap receptacle.

7. The cap hanger according to claim 3 further comprising a detent in said upper channel, said detent sized and configured to secure a back portion of said cap in said cap receptacle.

8. The cap hanger according to claim 1 further comprising an extension area in said cap receptacle, said extension area and said passageway forming an upper channel.

9. The cap hanger according to claim 8 further comprising a narrowed section disposed between said upper channel and said one or more lower channels.

10. The cap hanger according to claim 9, wherein said narrowed section has at least one side formed at an angle.

11. The cap hanger according to claim 8 further comprising a detent in said upper channel, said detent sized and configured to secure a back portion of said cap in said cap receptacle.

12. The cap hanger according to claim 1, wherein said hook is configured to be upstanding.

13. The cap hanger according to claim 1 further comprising a middle portion disposed between said upper portion and said lower portion, said middle portion configured to include a display item thereon.

14. The cap hanger according to claim 1 further comprising a slot in said hanger body for connection to an extension member.

15. The cap hanger according to claim 1 further comprising one or more brim clips at said lower portion, each of said brim clips configured to receive and retain a brim of said cap therein.

16. The cap hanger according to claim 15, wherein each of said brim clips comprise a pair of downwardly extending clip arms configured to flex upon insertion of said brim into said clip.

17. A cap hanger, comprising:

an upper portion configured to removably attach and retain said cap hanger on a support member;

a lower portion having a hanger body with a first end, an opposing second end, a top side and an opposing bottom side, said upper portion connected to said top side of said lower portion;

a middle portion disposed between said upper portion and said lower portion, said middle portion configured to include a display item thereon;

one or more hanger sections in said hanger body, each of said hanger sections having an opening at said bottom side of said hanger body connected to a passageway, said passageway interconnecting said opening with a cap receptacle, said hanger section having a protruding member disposed along said passageway and an extension area in said cap receptacle, said extension area and said passageway forming an upper channel; and one or more lower channels in said cap receptacle below said protruding member for receiving a back portion of a cap therein.

18. The cap hanger according to claim 17 further comprising a plurality of lower channels in said cap receptacle, each of said lower channels having a different channel width.

19. The cap hanger according to claim 17, wherein said cap receptacle has a narrowed section disposed between said upper channel and said plurality of lower channels, said narrowed section formed between a first side and an opposing second side, said second side comprised of said protruding member.

20. The cap hanger according to claim 17 further comprising a detent in said upper channel, said detent sized and configured to secure a back portion of said cap in said cap receptacle.

21. The cap hanger according to claim 17 further comprising one or more brim clips at said lower portion, each of said brim clips configured to receive and retain a brim of said cap therein.

22. The cap hanger according to claim 21, wherein each of said brim clips comprise a pair of downwardly extending clip arms configured to flex upon insertion of said brim into said clip.

23. A cap hanger, comprising:

an upper portion configured to removably attach and retain said cap hanger on a support member;

a lower portion having a hanger body with a first end, an opposing second end, a top side and an opposing bottom side, said upper portion connected to said top side of said lower portion;

a middle portion disposed between said upper portion and said lower portion, said middle portion configured to include a display item thereon;

one or more hanger sections in said hanger body, each of said hanger sections having an opening at said bottom side of said hanger body connected to a passageway, said passageway interconnecting said opening with a cap receptacle, said hanger section having a protruding member disposed along said passageway and an extension area in said cap receptacle, said extension area and said passageway forming an upper channel;

a detent in said upper channel, said detent sized and configured to secure a back portion of said cap in said cap receptacle;

one or more lower channels in said cap receptacle below said protruding member for receiving a back portion of a cap therein; and a narrowed section disposed between said upper channel and said one or more lower channels.

24. The cap hanger according to claim 23 further comprising a plurality of lower channels in said cap receptacle, each of said lower channels having a different channel width.

25. The cap hanger according to claim 23, wherein said narrowed section has at least one side formed at an angle.

26. The cap hanger according to claim 23 further comprising one or more brim clips at said lower portion, each of said brim clips configured to receive and retain a brim of said cap therein.

27. The cap hanger according to claim 26, wherein each of said brim clips comprise a pair of downwardly extending clip arms configured to flex upon insertion of said brim into said clip.

28. A cap hanger, comprising:

an upper portion configured to removably attach and retain said cap hanger on a support member;

a lower portion having a hanger body with a first end, an opposing second end, a top side and an opposing bottom side, said upper portion connected to said top side of said lower portion;

one or more hanger sections in said hanger body, each of said hanger sections having an opening at said bottom side of said hanger body connected to a passageway, said passageway interconnecting said opening with a cap receptacle, said hanger section having a protruding member disposed along said passageway; and a plurality of lower channels in said cap receptacle below said protruding member for receiving a back portion of a cap therein, each of said lower channels having a different channel width.

29. The cap hanger according to claim 28 further comprising an extension area in said cap receptacle, said extension area and said passageway forming an upper channel.

30. The cap hanger according to claim 29, wherein said cap receptacle has a narrowed section disposed between said upper channel and said plurality of lower channels, said narrowed section formed between a first side and an opposing second side, said second side comprised of said protruding member.

31. The cap hanger according to claim 30, wherein said first side is formed at an angle to facilitate entry of said cap into said lower channels.

32. The cap hanger according to claim 30 further comprising a detent in said upper channel, said detent sized and configured to secure a back portion of said cap in said cap receptacle.

33. The cap hanger according to claim 29 comprising a detent in said upper channel, said detent sized and configured to secure a back portion of said cap in said cap receptacle.

34. A cap hanger, comprising:

an upper portion configured to removably attach and retain said cap hanger on a support member;

a lower portion having a hanger body with a first end, an opposing second end, a top side and an opposing bottom side, said upper portion connected to said top side of said lower portion;

one or more hanger sections in said hanger body, each of said hanger sections having an opening at said bottom side of said hanger body connected to a passageway, said passageway interconnecting said opening with a cap receptacle, said hanger section having a protruding member disposed along said passageway and an extension area in said cap receptacle, said extension area and said passageway forming an upper channel; and one or more lower channels in said cap receptacle below said protruding member for receiving a back portion of a cap therein.

35. The cap hanger according to claim 34 further comprising a narrowed section disposed between said upper channel and said one or more lower channels.

36. The cap hanger according to claim 35, wherein said narrowed section has at least one side formed at an angle.

37. The cap hanger according to claim 34 further comprising a detent in said upper channel, said detent sized and configured to secure a back portion of said cap in said cap receptacle.

38. A cap hanger, comprising:

an upper portion configured to removably attach and retain said cap hanger on a support member;

a lower portion having a hanger body with a first end, an opposing second end, a top side and an opposing bottom side, said upper portion connected to said top side of said lower portion;

one or more hanger sections in said hanger body, each of said hanger sections having an opening at said bottom side of said hanger body connected to a passageway, said passageway interconnecting said opening with a cap receptacle, said hanger section having a protruding member disposed along said passageway;

one or more lower channels in said cap receptacle below said protruding member for receiving a back portion of a cap therein; and one or more brim clips at said lower portion, each of said brim clips configured to receive and retain a brim of said cap therein.

39. The cap hanger according to claim 38, wherein each of said brim clips comprise a pair of downwardly extending clip arms configured to flex upon insertion of said brim into said clip.

* * * * *